US011486390B2

(12) United States Patent
Reynolds et al.

(10) Patent No.: US 11,486,390 B2
(45) Date of Patent: Nov. 1, 2022

(54) STATOR WITH MODULAR INTERIOR

(71) Applicant: Roper Pump Company, Commerce, GA (US)

(72) Inventors: Cody Richard Reynolds, Covington, GA (US); Edmond Coghlan, III, Blairsville, GA (US); Tyson Bentley Anderson, Watkinsville, GA (US)

(73) Assignee: Roper Pump Company, LLC, Wilmington, DE (US)

( * ) Notice: Subject to any disclaimer, the term of this patent is extended or adjusted under 35 U.S.C. 154(b) by 0 days.

(21) Appl. No.: 17/234,181

(22) Filed: Apr. 19, 2021

(65) Prior Publication Data

US 2021/0324853 A1 Oct. 21, 2021

Related U.S. Application Data

(60) Provisional application No. 63/013,286, filed on Apr. 21, 2020.

(51) Int. Cl.
*F04C 2/107* (2006.01)
*F04C 13/00* (2006.01)

(52) U.S. Cl.
CPC ..... *F04C 2/1075* (2013.01); *F04C 13/008* (2013.01); *F04C 2230/60* (2013.01); *F04C 2240/10* (2013.01); *F04C 2240/70* (2013.01); *F04C 2250/30* (2013.01)

(58) Field of Classification Search
CPC ..... F04C 2/107–1078; F04C 18/1075; F04C 2240/10; F04C 2240/70; F04C 2250/30; F01C 1/101
See application file for complete search history.

(56) References Cited

U.S. PATENT DOCUMENTS 5,474,432 A * 12/1995 Hulley ..... F04C 2/1075 418/48
5,832,604 A 11/1998 Johnson et al.
6,905,319 B2 6/2005 Guo
7,407,372 B2 8/2008 Guidry et al.
8,888,419 B2 11/2014 Wilmot
8,967,985 B2 3/2015 Coghlan, III et al.
(Continued)

FOREIGN PATENT DOCUMENTS

CA 2532756 C 3/2011
DE 2907392 A1 * 8/1980
(Continued)

*Primary Examiner* — Laert Dounis
(74) *Attorney, Agent, or Firm* — Snyder, Clark, Lesch & Chung, LLP

(57) ABSTRACT

A stator segment is provided for a helical gear device. The stator segment includes a stator tube and modular stator inserts. The stator tube has an inner profile with at least two internal sides that extend longitudinally along an interior of the stator tube. The modular stator inserts each have an outer profile that substantially matches and fits within the inner profile of the stator tube. The modular stator inserts also each have an interior helical profile that defines a central opening. The modular stator inserts are configured to be removably inserted longitudinally into the stator tube along the inner profile of the stator tube. The inner profile aligns the modular stator inserts to form a continuous helical chamber and prevents rotation of the modular stator inserts relative to the stator tube.

20 Claims, 11 Drawing Sheets

(56) References Cited

U.S. PATENT DOCUMENTS

| | | | | |
|---|---|---|---|---|
| 9,416,780 | B2 | 8/2016 | Steele | |
| 9,784,269 | B2 | 10/2017 | Lehr et al. | |
| 9,796,834 | B2 | 10/2017 | Kyker | |
| 10,215,176 | B2 | 2/2019 | Cariveau et al. | |
| 2006/0131079 | A1* | 6/2006 | Bottos | F04C 2/1075 175/107 |
| 2006/0182644 | A1* | 8/2006 | Delpassand | F04C 2/1075 418/45 |
| 2007/0059191 | A1* | 3/2007 | Kreidl | F04C 2/1075 418/48 |
| 2008/0050259 | A1 | 2/2008 | Hooper | |
| 2009/0074599 | A1* | 3/2009 | Tekneyan | F04C 2/1075 418/153 |
| 2011/0116960 | A1* | 5/2011 | Akbari | F04C 13/002 418/48 |
| 2011/0116961 | A1 | 5/2011 | Akbari et al. | |
| 2018/0066654 | A1 | 3/2018 | Cariveau et al. | |
| 2019/0145374 | A1 | 5/2019 | Parhar et al. | |

FOREIGN PATENT DOCUMENTS

| | | | | |
|---|---|---|---|---|
| EP | 2256345 | A2 | 12/2010 | |
| WO | WO-2012090968 | A1 * | 7/2012 | F04C 2/1075 |

* cited by examiner

STATOR WITH MODULAR INTERIOR

CROSS REFERENCE TO RELATED APPLICATION

This application claims priority under 35 U.S.C. § 119, based on U.S. Provisional Patent Application No. 63/013,286 filed Apr. 21, 2020, titled "Stator with Modular Interior," the disclosure of which is hereby incorporated by reference.

BACKGROUND OF THE INVENTION

The present invention relates to stator segments for progressing cavity devices, and more particularly to stators segments that have modular components.

There are three common types of mud drilling stators inside of which a metal rotor spins during drilling. One type is a deformable, elastomer-lined stator. A second type is a rigid, non-deformable stator, typically constructed from metal. A third type, referred to as an even walled stator, uses a rigid, non-deformable stator with an even layer of elastomer lining along the inside of the rigid portion.

Progressing cavity pumps are frequently used in applications to handle highly viscous fluids and fluids containing solids. Even small solids can cause rapid abrasive wear to the stator, which can necessitate frequent stator replacement and/or refurbishment.

DETAILED DESCRIPTION OF THE PREFERRED EMBODIMENTS

The following detailed description refers to the accompanying drawings. The same reference numbers in different drawings may identify the same or similar elements.

Stators that utilize elastomer are typically injected from one or both ends. Many of the stators are very long, and successfully injecting the elastomer across these lengths can be a challenge. There are many steps in the injection process in order to ensure that the elastomer is bonded sufficiently to the tube. There are also many variables that can affect the outcome of the injection process. When the elastomer stators wear out over time, the elastomer must be cut out and re-injected to be put back into use.

Conversely, rigid stators are currently expensive to manufacture with extensive processing time and wasted material. The geometry, as well as the manufacturing processes, limit the materials that the stator can be made from as well as material configurations. This limitation prohibits materials and coatings that would aid in abrasion resistance. When rigid stators wear out, they typically have to be replaced completely.

According to an implementation described herein, a stator assembly is provided with sections or modules on the interior that are slid together inside a long metal outer tube of the stator. The long metal outer tube (referred to herein as a "stator tube") has an inner profile that mates with the outer profile of the internal sectioned pieces (referred to herein as "modular stator inserts"). This mating of profiles of the stator tube and modular stator inserts orient the modular stator inserts correctly and eliminate the need for the bonding process that is typically used to inject elastomer inside the tube. The modular stator inserts can be made up of any material allowing for mixing and matching of material options, as well as the ability to use different materials without the concerns of processability.

Because the inner section of the stator is made up of a multiple of modular stator inserts, the manufacture of the modular stator inserts will allow for more elastomer material options due to the easier inject-ability. Thus, a significant amount of the typical manufacturing processes can be reduced or eliminated altogether.

According to implementations described herein, when one or more modular stator inserts wears out, the modular stator inserts can be removed from the stator tube and replaced on site, eliminating waste, reducing down time for the customer, and eliminating the need for re-injection of the elastomer.

Figure 1:
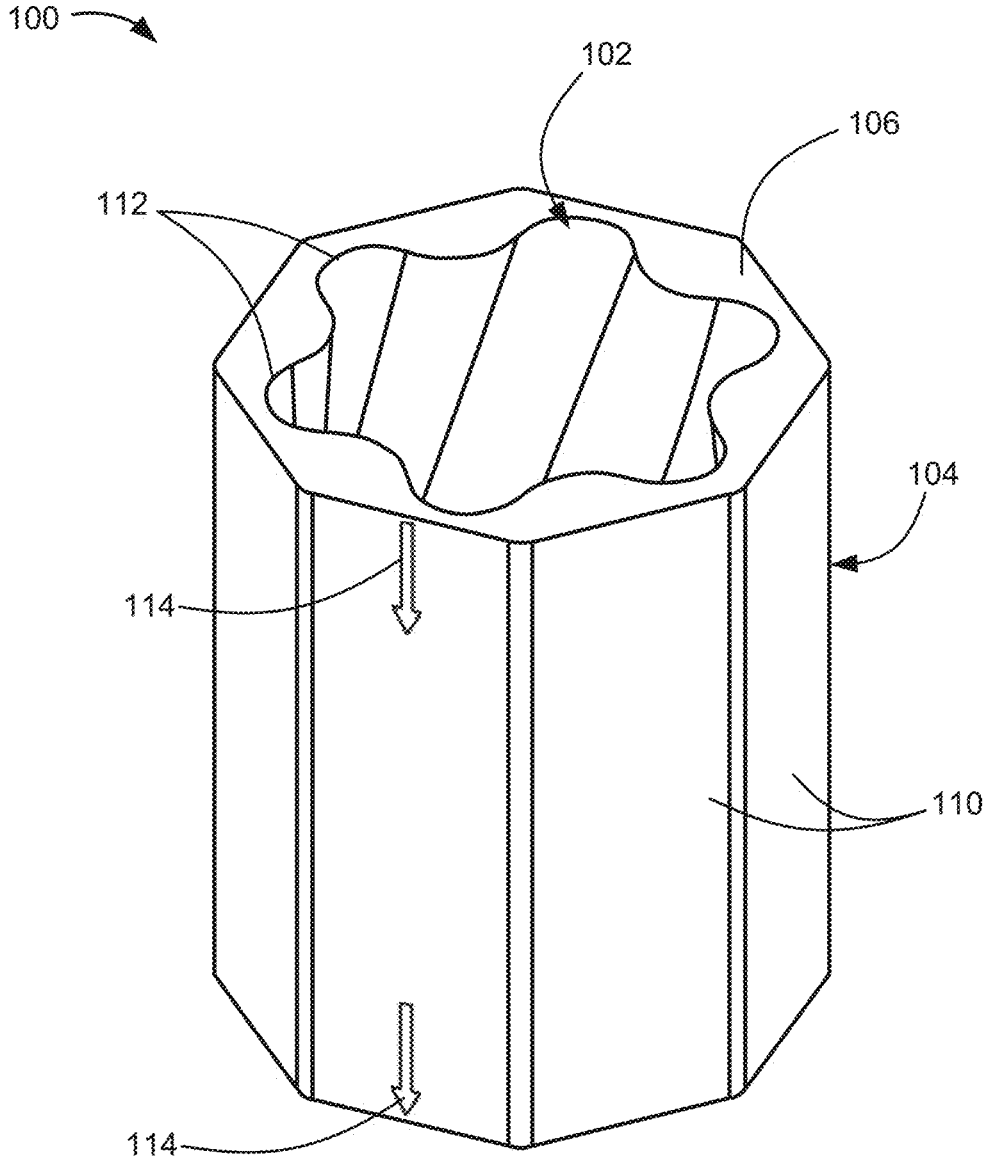
FIG. 1 is a perspective view of a modular stator insert, according to an implementation.
Figure 3:
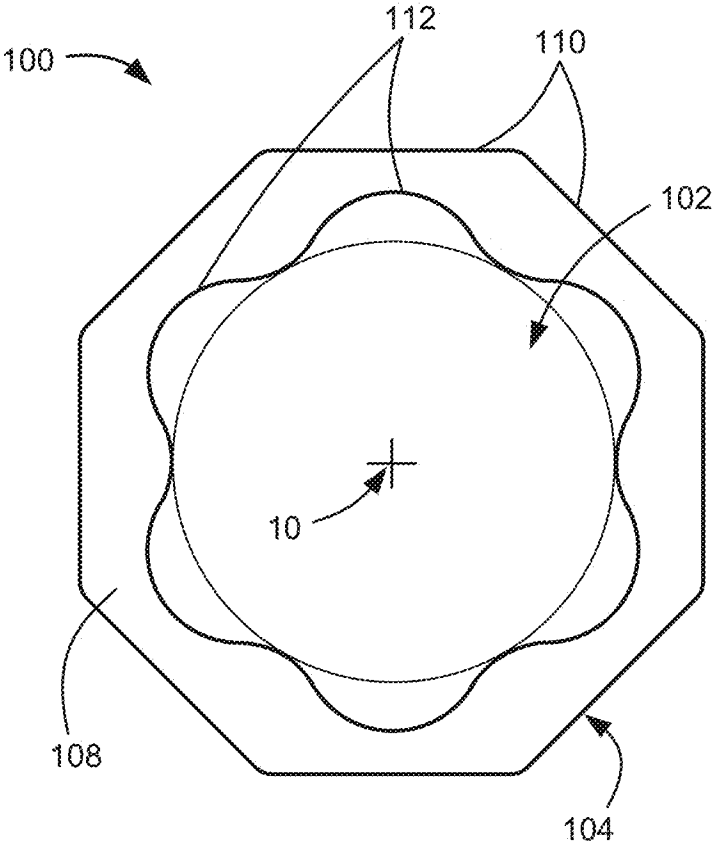
FIG. 3 is an end view of the modular stator insert of FIG. 1.

FIG. 1 depicts a perspective view of a modular stator insert 100, and FIG. 3 depicts an end view of modular stator insert 100. Referring to FIGS. 1 and 3, modular stator insert 100 includes an internal cavity 102, an outer profile 104, an inlet end 106 (FIG. 1), and an outlet end 108 (FIG. 3). Outer profile 104 includes multiple sides 110 extending longitudinally between inlet end 106 and outlet end 108 and substantially parallel to a central axis 10. Internal cavity 102 may include multiple helical lobes 112.

Internal cavity 102 of modular stator insert 100 has an interior helical profile that defines a central opening. Modular stator insert 100 is configured to accept a rotor (not shown) of helical contour that rotates within internal cavity 102. The rotor generally has a one or more lobes or helices that match the configuration of lobes 112 in modular stator insert 100. Generally, the rotor has one fewer lobes than the number of lobes 112 in modular stator insert 100 to facilitate a pumping rotation. The lobes of the rotor and lobes 112 engage to form sealing surfaces and cavities there between. For a drilling motor, fluid is pumped into cavity 102 at inlet end 106 at a higher pressure than that at outlet end 108, which creates forces that cause the rotor to rotate within modular stator insert 100.

According to implementations described herein, modular stator insert 100 may be stackable with other modular stator inserts 100 to form a long stator section with a continuous internal helical cavity. For example, lobes 112 may be configured to align with lobes of another modular stator insert when inlet end 106 abuts an outlet end of the other modular stator insert. According to one implementation, indicators 114 may be included on one or more of sides 110 to ensure proper rotational alignment during assembly. According to another implementation, the number of sides 110 and lobes 112 may be configured to so that lobes 112 will align in any rotational orientation where sides 110 align.

Modular stator insert 100 may be formed from any of a variety of materials, including metal materials and elastomers. Because of the relatively short segment size of modular stator insert 100, different materials may be used than would be otherwise be available for use in long stator segments. For example, modular stator insert 100 may be casted, injection molded, and/or coated as individual pieces that can be aligned inside a stator tube to form a continuous helical cavity (or chamber) for a rotor. In some implementations, modular stator insert 100 may be made from metal, such as steel, bronze, or iron. In other implementations, modular stator insert 100 may be formed from special materials, such as titanium, ceramic, or hardened tool steel. In still other implementations, modular stator insert 100 may be formed from an elastomeric material, such as rubber. In other implementation, modular stator insert 100 may include a combination of metal and non-metal materials. Such as a metal piece that is coated with an elastomer on one or more surfaces.

Figure 2:
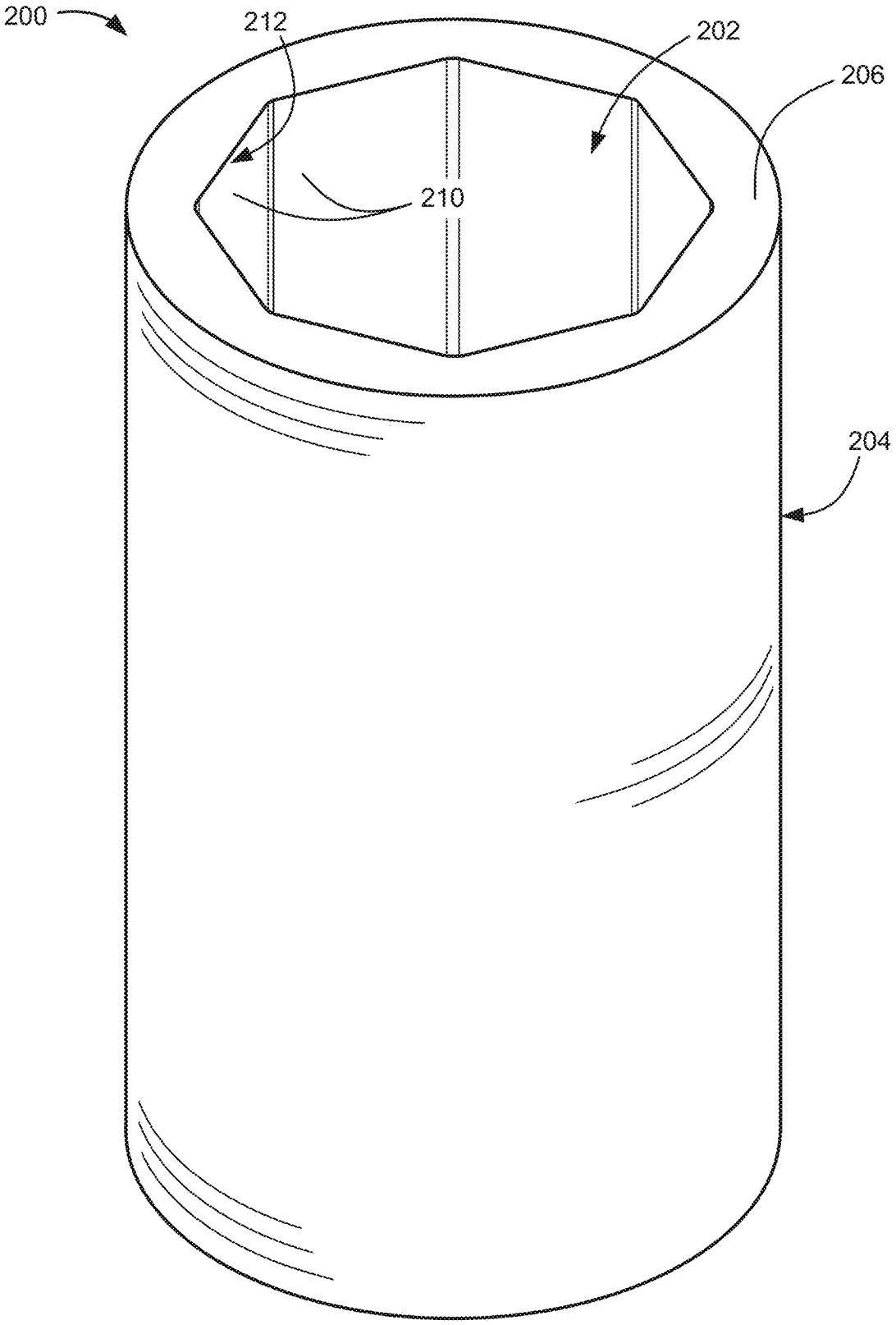
FIG. 2 is a perspective view of a stator tube configured to hold the modular stator insert of FIG. 1, according to an implementation.
Figure 4:
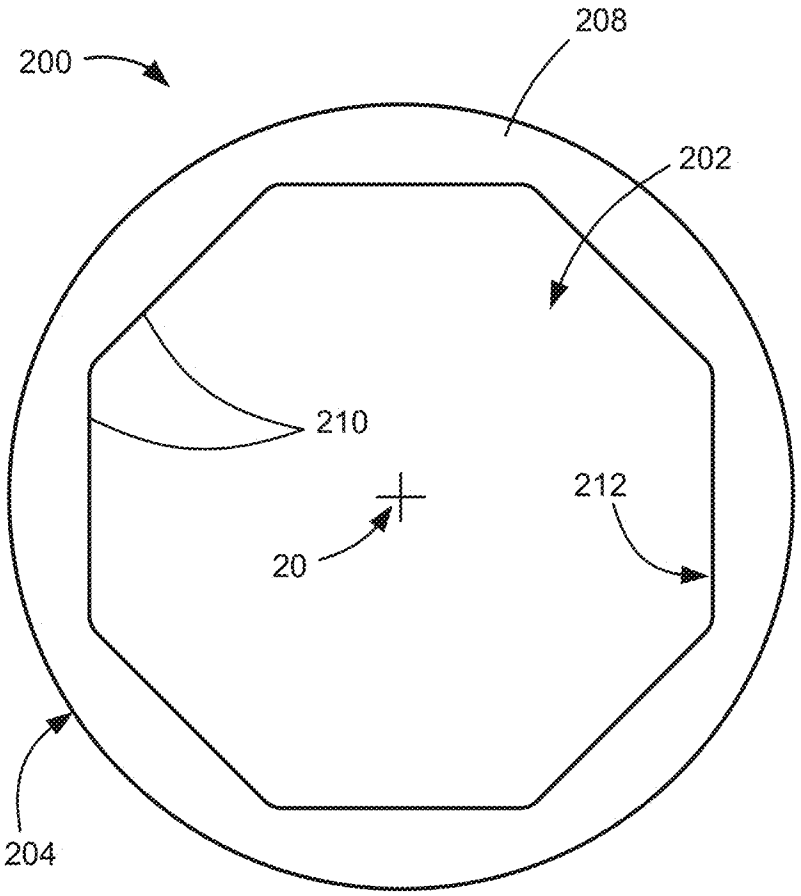
FIG. 4 is an end view of the stator tube of FIG. 2.

FIG. 2 depicts a perspective view of a stator tube 200, and FIG. 4 depicts an end view of stator tube 200. Referring to FIGS. 2 and 4, stator tube 200 includes an internal cavity 202, an external surface 204, an inlet end 206 (FIG. 2), and an outlet end 208 (FIG. 4). External surface 204 may include a circular perimeter extending longitudinally between inlet end 206 and outlet end 208 and substantially parallel to a central axis 20. Internal cavity 202 includes multiple internal sides 210 that form an inner profile 212, where inner profile 212 corresponds to outer profile 104 of modular stator insert 100. For example, the number, size, and arrangement of sides 210 corresponds to the number, size, and arrangement of sides 110 such that modular stator insert 100 may slide within cavity 202.

Stator tube 200 may be formed from a metal material, such as steel. In another implementation, stator tube 200 may be cast from iron or another material. In still other implementations, stator tube 200 may be formed using polymers or composite materials. According to one implementation, stator tube 200 may be significantly longer that modular stator insert 100, such that multiple modular stator inserts 100 may fit stacked end-to-end inside cavity 202.

Figure 5:
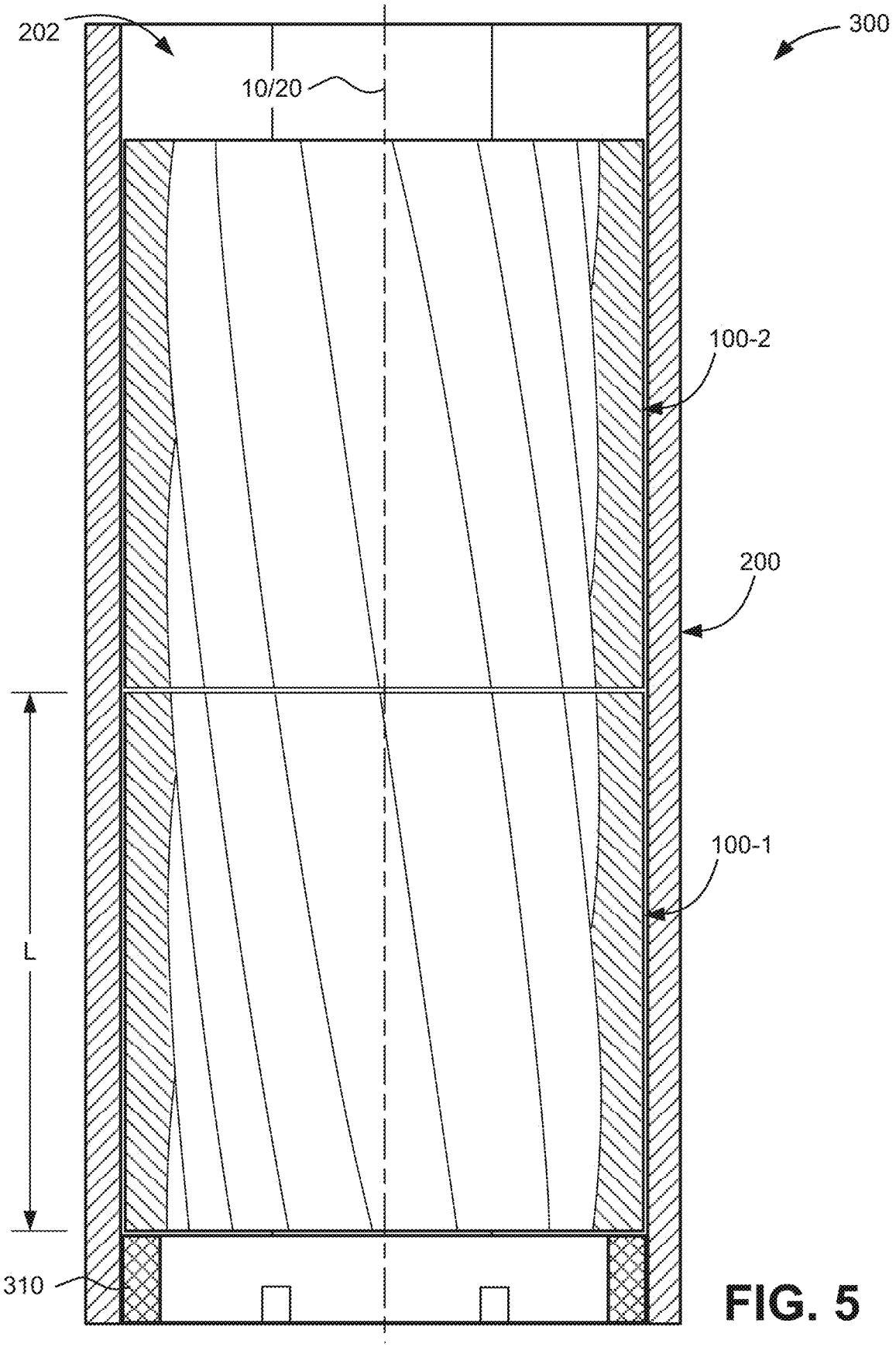
FIG. 5 is a longitudinal cross-section view of a stator assembly including the stator tube of FIG. 2 with multiple modular stator inserts disposed therein.
Figure 6:
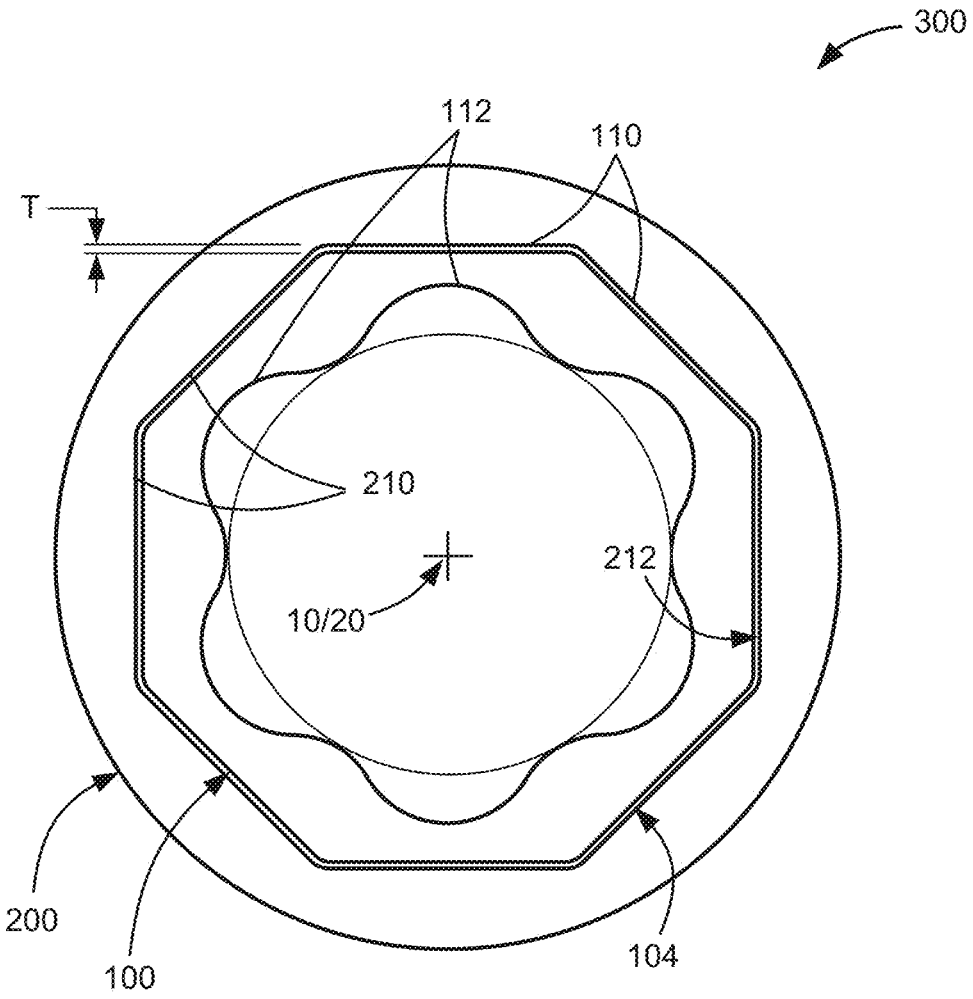
FIG. 6 is a top end view along section of the stator assembly of FIG. 5.
Figure 7:
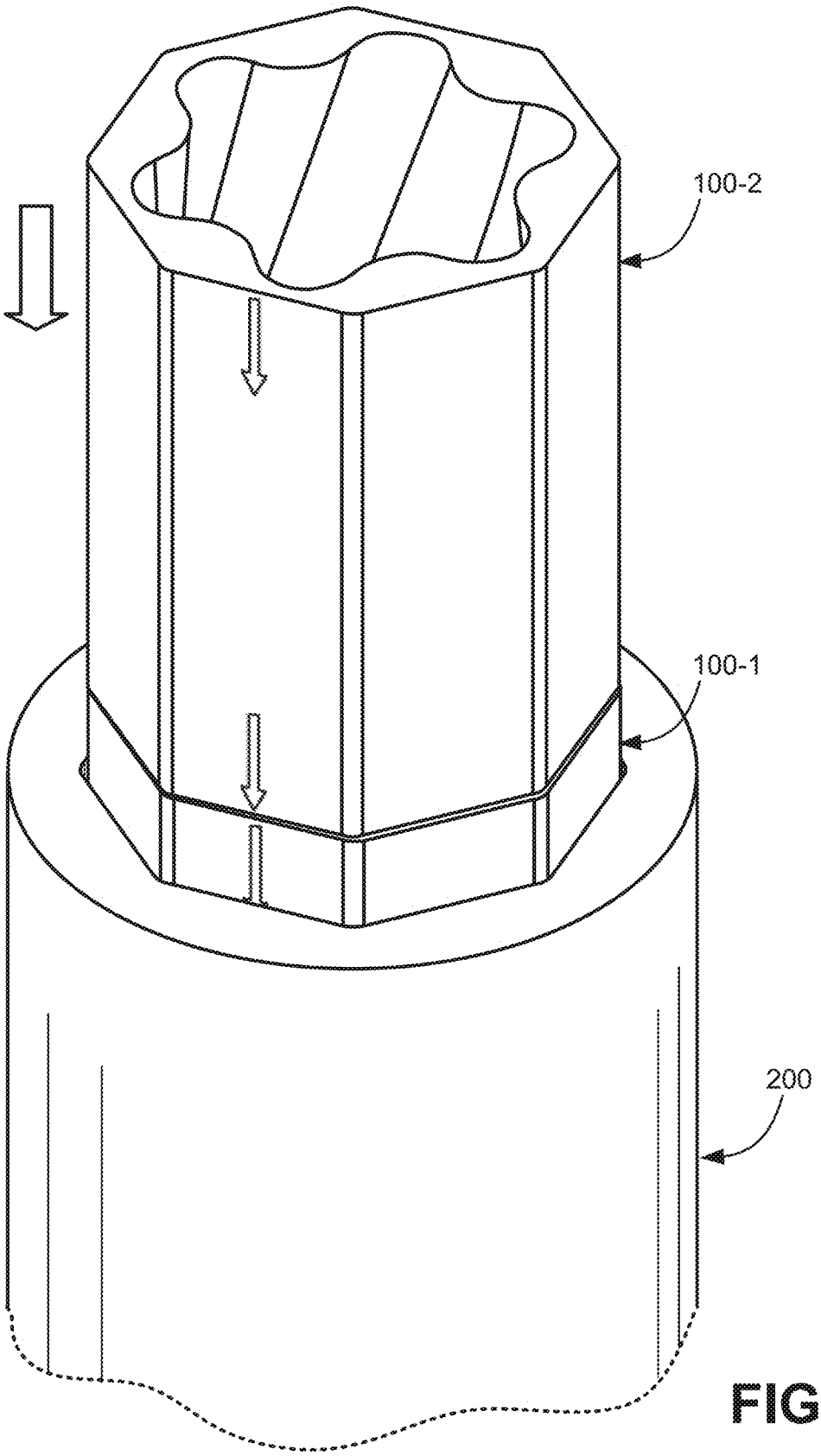
FIG. 7 is a partial assembly view of the stator assembly of FIG. 5.

FIG. 5 is a longitudinal cross-section view of a stator assembly 500 (also referred to herein as a "stator segment") including stator tube 200 with multiple modular stator inserts 100-1 and 100-2 disposed therein. FIG. 6 is a top end view of stator assembly 300. FIG. 7 is a partial assembly view of stator assembly 300. Modular stator inserts 100 may be inserted into cavity 202 of stator tube 200 at inlet end 206, for example. Modular stator inserts 100 may be inserted end-to-end, for example, such that outlet end 108 of one modular stator insert 100 (e.g., modular stator insert 100-2 of FIG. 5) contacts inlet end 106 of another modular stator insert 100 (e.g., modular stator insert 100-1 of FIG. 5). Two modular stator inserts 100 are shown in FIG. 5 for simplicity. In other implementations, several or dozens of modular stator inserts 100 may be used within a single stator tube.

Each of modular stator inserts 100 may have an axial length, L. Axial length L may correspond to a length that permits continuous alignment of lobes 112 between modular stator inserts 100. For example, in one implementation, when indicators 114 are aligned on modular stator insert 100-1 and 100-2, respective cavities 102 may form a continuous helical path. According to other implementations, the profile 104 and/or number of sides 110 may be configured so that respective lobes 112 and cavities 102 of modular stator inserts 100 will align for any rotational orientation that fits within the profile of cavity 202. Thus, for a cavity 102 with six lobes 112, axial length L, at a minimum, may be sufficient to include a helical path of 60 degrees for each lobe 112. For a cavity 102 with four lobes 112, axial length L, at a minimum, may be sufficient to include a helical path of 90 degrees for each lobe 112. As a non-limiting example, axial length L may generally be a few inches (e.g., between 3-8 inches) for a stator tube 200, which may have an axial length of over 100 inches.

According to one implementation, axial length L may be the same for each modular stator insert 100. According to another implementation, some modular stator inserts 100 may have different lengths that are multiples of L (e.g., 2*L, 3*L, etc.). For example, in one implementation modular stator inserts 100 made from elastomer materials may have a different length (e.g., L) than modular stator inserts 100 made from metal materials (e.g., 2*L).

According to an implementation, modular stator inserts 100 may be manually inserted into stator tube 200, with a first modular stator insert 100 (e.g., modular stator insert 100-1 of FIG. 5) eventually contacting a stopper ring 310. Stopper ring 310 may be affixed to sides 210 at an end of stator tube 200. Stopper ring 310 may, for example, be bolted, threaded, welded, indexed, or otherwise mechanically secured to stator tube 200. According to an implementation, stopper ring 310 may be removable from stator tube 200 to facilitate removal of modular stator inserts 100 as described further herein.

According to one implementation, as best shown in FIG. 6, modular stator inserts 100 and stator tube 200 may be configured with a tolerance, T, between each side 110/210. The configured tolerance, T, may be different for different material types. For example, for a modular stator insert 100 with steel walls 110 and a steel stator tube 200, T may be about 10 mils (10 thousands of an inch). Conversely, for a modular stator insert 100 with elastomer walls 110 and a steel stator tube 200, T may be larger than 10 mils.

Figure 8:
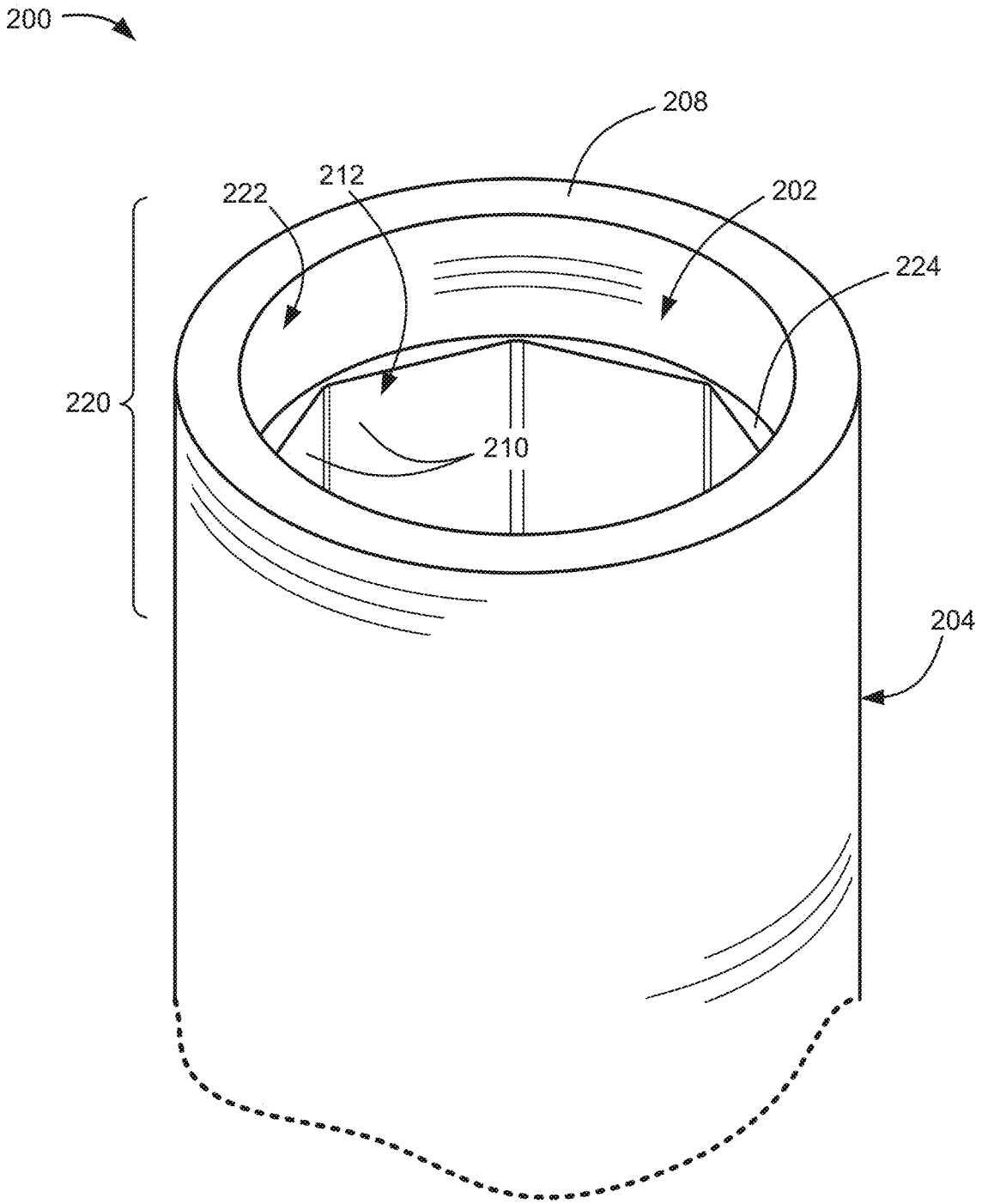
FIG. 8 is a perspective view of a portion of a stator tube adjacent an outlet end, according to another embodiment.

FIG. 8 is a perspective view of a portion 220 of stator tube 200 adjacent outlet end 208 according to another embodiment. As shown in FIG. 8, portion 220 at an end section of stator tube 200 may be configured with a different (e.g. circular) profile 222 to receive stopper ring 310. Stopper ring 310 may be, for example, threaded onto profile 222 to abut against a shoulder 224 formed at the interface between profile 212 and 222. In one implementation, the circular end section of stator tube 200 may be machined as an integral piece with the profiled 212 section.

According to one aspect, to support threaded connections, portion 220 may be hardened to provide additional material strength for threaded connections. According to another implementation, the portion of stator tube 200 adjacent inlet end 206 may be configured similarly to the portion 220 of stator tube 200 adjacent outlet end 206.

FIGS. 9A-9F are end views of different configurations for stator assemblies that may correspond to stator assembly 300. FIGS. 9A-9F provide non-limiting examples of different cross-sectional shapes and material combinations that may be used for modular stator insert 100 and stator tube 200. While six lobes 112 are used in the cavities 102 of the modular stator inserts 100 in the stator assemblies of FIGS. 9A-9F, any other number of lobes 112 may be used in different embodiments.

Figure 9A:
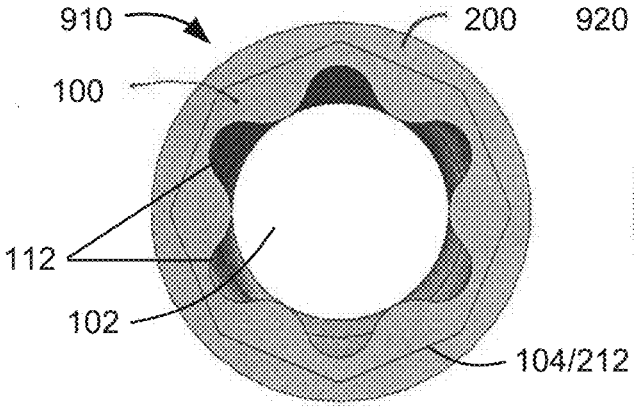
FIGS. 9A-9F are end views of different stator tube and modular stator inserts, according to different implementations.

Referring to FIG. 9A, a stator assembly 910 may include a metal modular stator insert 100 and a metal stator tube 200. Modular stator insert 100 and stator tube 200 in stator assembly 910 may have corresponding octagonal-shaped profiles 104/212.

Figure 9B:
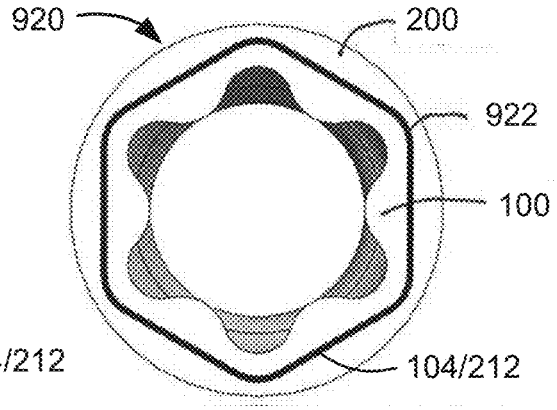

Referring to FIG. 9B, a stator assembly 920 may include a modular stator insert 100 with an elastomer outer coating 922 and a metal stator tube 200. Modular stator insert 100 may include elastomer outer coating 922 along walls 110 (e.g., FIG. 1). Elastomer outer coating 922 may be applied and cured, for example, prior to insertion of modular stator inserts 100 into stator tube 200. Modular stator insert 100 and stator tube 200 in stator assembly 920 may have corresponding hexagonal-shaped profiles 104/212.

Figure 9C:
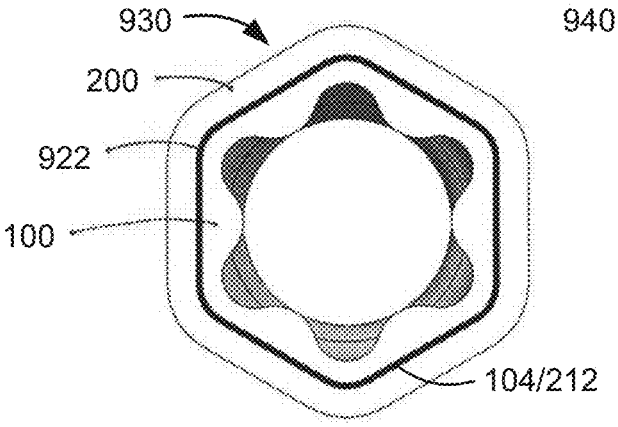

Similar to FIG. 9B, in FIG. 9C, a stator assembly 930 may include a modular stator insert 100 with an elastomer outer coating 922 and a metal stator tube 200. Modular stator insert 100 and stator tube 200 in stator assembly 930 may have corresponding hexagonal-shaped profiles 104/212.

Figure 9D:
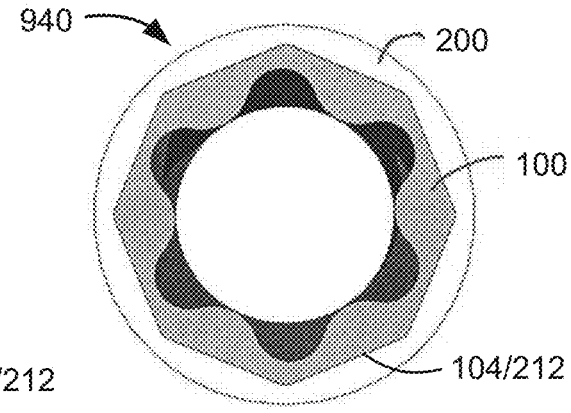

Referring to FIG. 9D, a stator assembly 940 may include an elastomer modular stator insert 100 and a metal stator tube 200. Modular stator insert 100 may be a solid elastomer module that is molded and cured, for example, prior to insertion of modular stator inserts 100 into stator tube 200. Modular stator insert 100 and stator tube 200 in stator assembly 940 may have corresponding octagonal-shaped profiles 104/212.

Figure 9E:
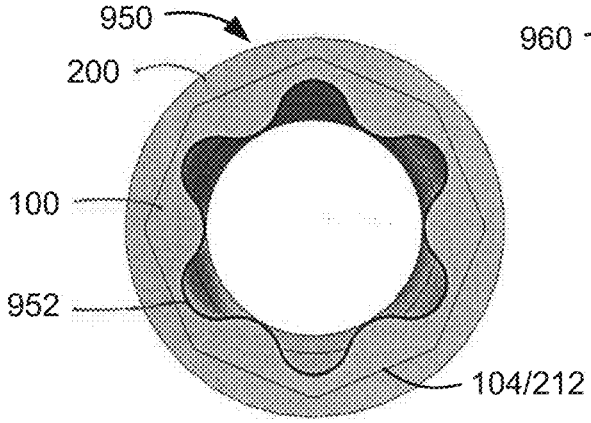

Referring to FIG. 9E, a stator assembly 950 may include a modular stator insert 100 with an inner elastomer layer 952 and a metal stator tube 200. Modular stator insert 100 may include elastomer coating 952 along the sides of internal cavity 102 (e.g., FIG. 1). Elastomer coating 952 may include for example, and elastically deformable material, such as rubber, with an even or smooth profile. Elastomer coating 952 may be applied and cured, for example, prior to insertion of modular stator inserts 100 into stator tube 200. Modular stator insert 100 and stator tube 200 in stator assembly 950 may have corresponding octagonal-shaped profiles 104/212.

Figure 9F:
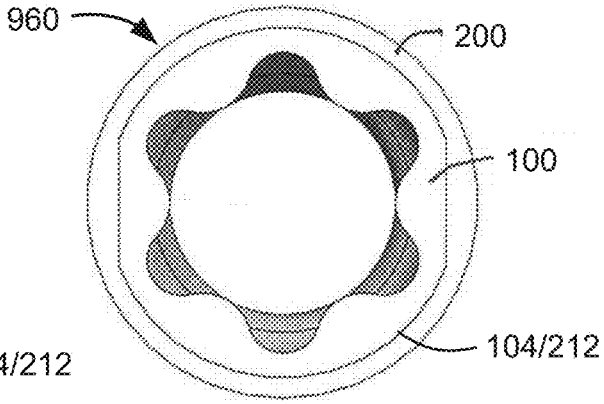

Referring to FIG. 9F, a stator assembly 960 may include a metal modular stator insert 100 and a metal stator tube 200. Modular stator insert 100 and stator tube 200 in stator assembly 960 may have corresponding profiles 104/212 with non-equilateral sides. In the example of FIG. 9F, two straight sides are shown. Generally, any cross-sectional shape of profile 104 (and corresponding profile 212) that includes at least one straight side may be used to prevent rotation of modular stator insert 100 within stator tube 200. In other implementations, the cross-section of profile 104 may have any regular or irregular convex polygon shape.

Although FIGS. 9A-9F show exemplary configurations of some different stator sections, in other implementations, various other material types and profile shapes may be used. For example, three, four, five or more sides may be used for profiles 104/212. Furthermore, profiles 104/212 may also include other combinations of straight and curved surfaces.

Figure 10:
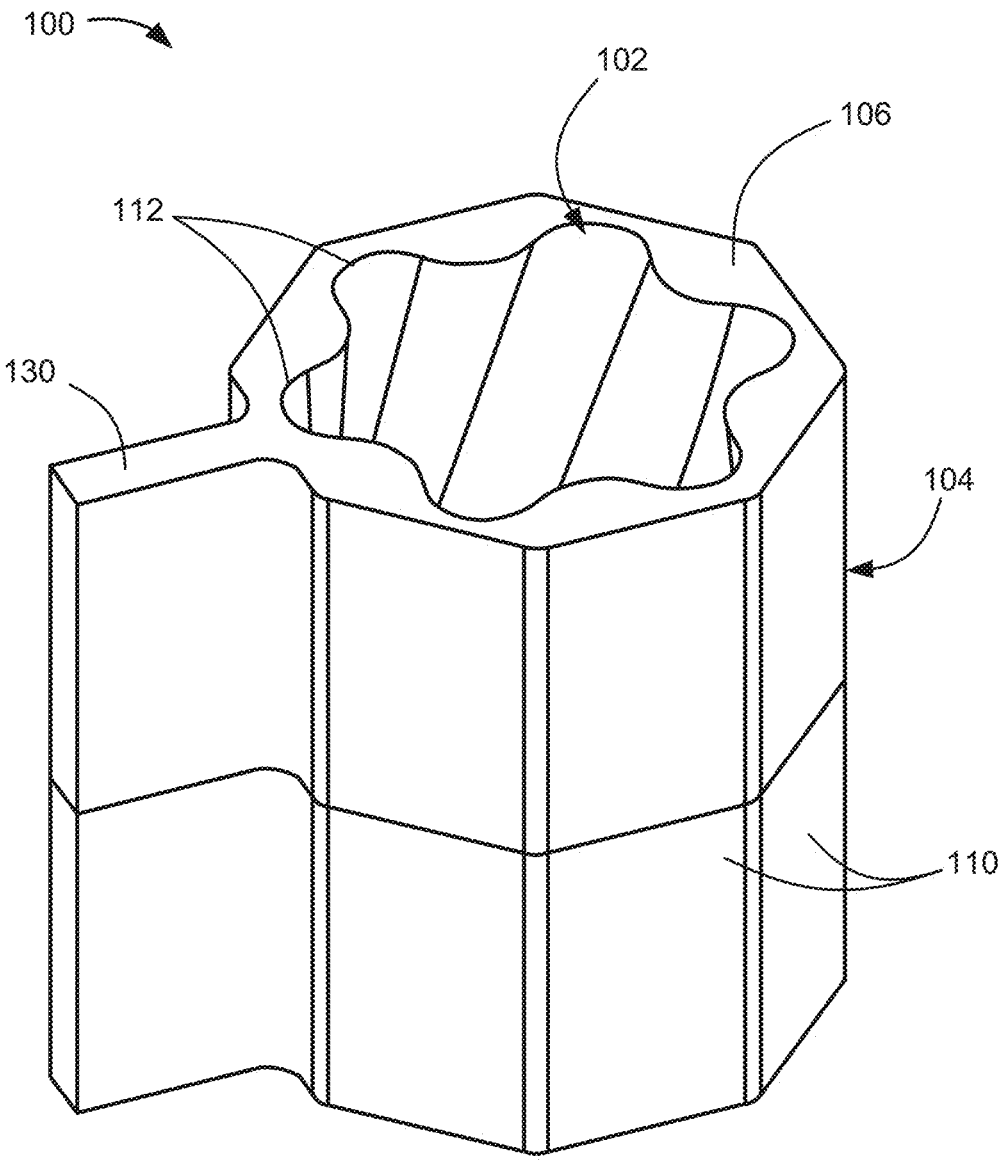
FIG. 10 is a perspective view of a cast modular stator insert including extra holding material.

FIG. 10 is a perspective view of a modular stator insert 100 shown as a cast piece. According to one embodiment, modular stator insert 100 may be a casted metal (e.g., bronze) component with machined surfaces. For example, after casting, secondary machining of sides 110 may be performed to ensure a proper fit and smooth entry of modular stator insert 100 into cavity 202 of stator tube 200. Additionally, machining of inlet end 106 and outlet end 108 (FIG. 3) may be performed to ensure flush end-to-end abutment of different modular stator inserts 100 within cavity 202 of stator tube 200. In the example of FIG. 10, modular stator insert 100 may include extra material 130 for holding purposes during the secondary machining. Extra material 130 may be removed, for example, after secondary machining is complete.

Figure 11:
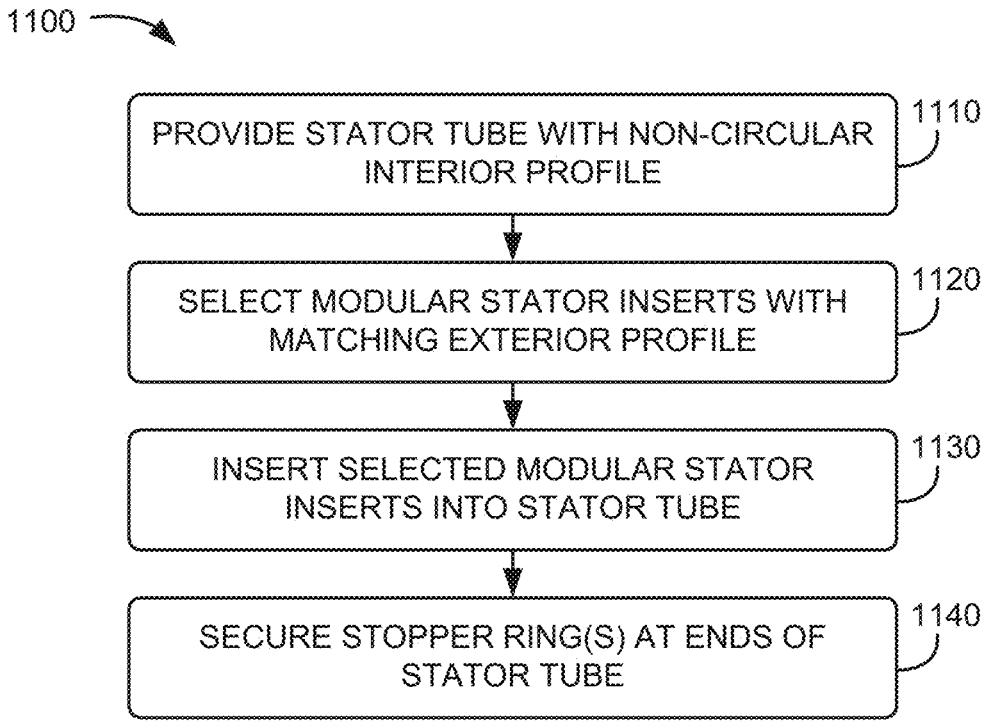
FIG. 11 is a flow diagram illustrating a process for forming a new stator assembly, according to an implementation described herein.

FIG. 11 is a flow diagram of a process 1100 for forming a new stator assembly 300 for a hydraulic motor or pump, according to an implementation described herein. Process 1100 may include providing a stator tube with a non-circular inner profile (block 1110). For example, a technician may select a stator tube 200 for a required pump size. As described above, stator tube 200 may have a non-circular inner profile 212, such as hexagonal, octagonal, or other convex polygonal profile.

Process 1100 may also include selecting modular stator inserts with an exterior profile that matches the inner profile (block 1120). For example, a technician may select a set of previously-manufactured modular stator inserts 100 that have an exterior profile 104 that is configured to slide within cavity 202 of stator tube 200. The selected modular stator inserts 100 may include a number of inserts sufficient to extend along the entire length of profile 212 when modular stator inserts 100 are stacked end-to-end. In one implementation, the same material configuration (e.g., one of the material types/combinations described in connect with FIGS. 9A-9F) may be selected for each of the modular stator inserts 100. In another implementation, modular stator inserts 100 with different material configuration may be used. For example, a sequence of metal modular stator inserts 100 and rubber modular stator inserts 100 may be used in stator tube 200. As another example, a sequence of solid rubber modular stator inserts 100 (e.g., FIG. 9D) and elastomer lined metal modular stator inserts 100 may be used in stator tube 200.

Process 1100 may also include inserting the selected modular stator inserts into stator tube (block 1130), and securing one or more stopper rings at the ends of the stator tube (block 1140). For example, a technician may insert the selected set of modular stator inserts 100 into cavity 202 of stator tube 200. The non-circular inner profile 212 and matching exterior profile 104 may prevent axial rotation of modular stator inserts 100 relative to stator tube 200. According to an implementation, the technician may align indicators 114 to ensure that helical lobes 112 in the internal cavity 102 of each modular stator insert 100 are properly oriented for rotational alignment and flow direction. According to another implementation, modular stator inserts 100 may be configured to align internal cavities 102 at any rotational orientation indexed within profile 212. A stopper ring 310 may be secured at a portion of stator tube 200 adjacent outlet end 208 and another stopper ring 310 may be secured at a portion of stator tube 200 adjacent inlet end 206. In one implementation, the stopper ring 310 adjacent outlet end 208 may be secured to stator tube 200 prior to insertion of modular stator inserts 100, and the stopper ring 310 adjacent inlet end 206 may be secured to stator tube 200 after the insertion of modular stator inserts 100.

Figure 12:
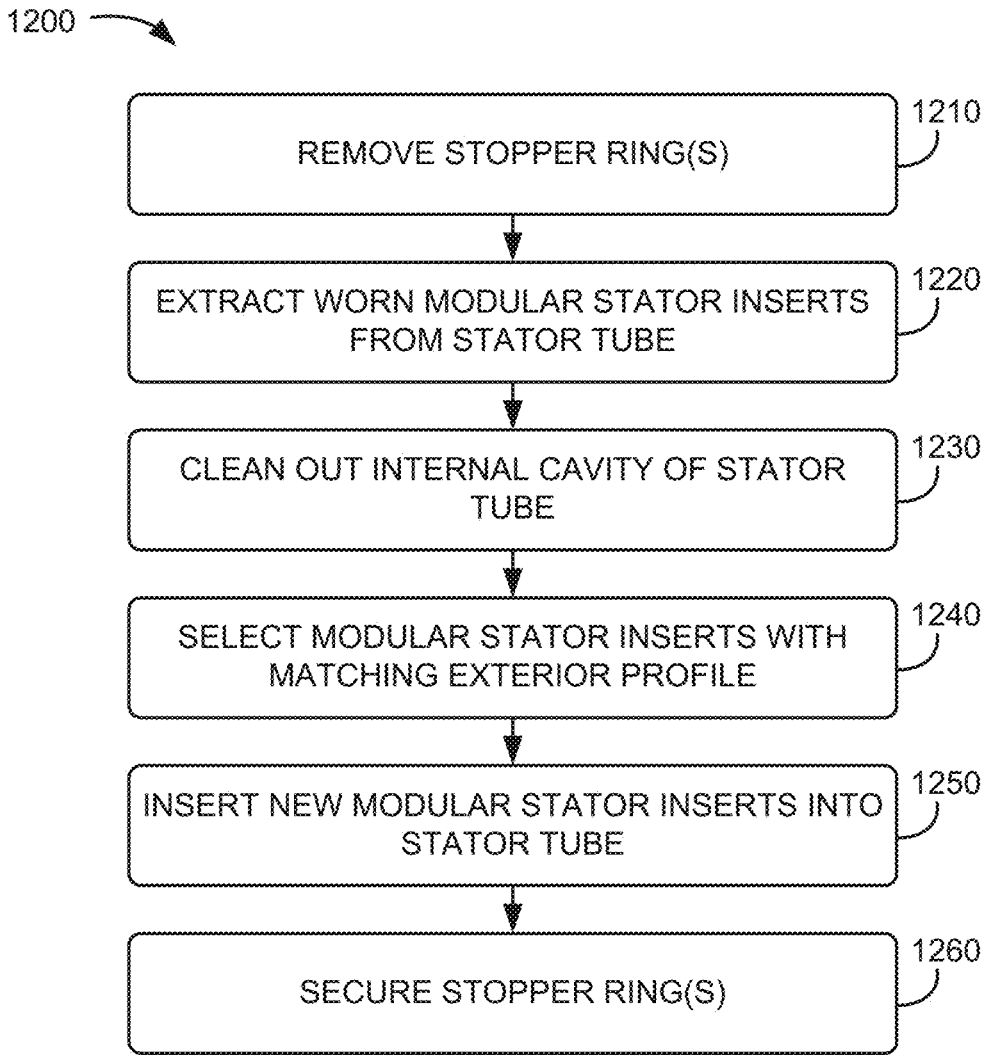
FIG. 12 is a flow diagram illustrating a process for re-furbishing a stator assembly, according to an implementation described herein.

FIG. 12 is a flow diagram of a process 1200 for refurbishing a stator assembly 300 for a hydraulic motor or pump, according to an implementation described herein. Process 1200 may be performed as a field operation. Process

1200 may include removing one or more stopper rings from the stator tube (block 1210). For example, according to one implementation, stopper rings 310 may be unbolted or threaded off the end portions of stator tube 200 to create a path for modular stator inserts 100 within cavity 202 to be pushed out.

Process 1200 may also include extracting worn modular stator inserts from the stator tube (block 1220), and cleaning out the internal cavity of the stator tube (block 1230). For example, modular stator inserts 100 may be slid out from stator tube 200 using a push rod or similar tool. A cleaning brush or pressure wash may be used to ensure cavity 202 of stator 200 is free of debris and/or residue.

Process 1200 may further include selecting modular stator inserts with a matching exterior profile (block 1240), inserting new modular stator inserts into the stator tube (block 1250), and one or more stopper rings at the ends of the stator tube (block 1260). For example, as described above in connection with process blocks 1120-1140 of process 1100, a technician may select, insert, and secure a new set of modular stator inserts 100 within cavity 202 of stator tube 200. In process 1200, the selected modular stator inserts 100 may be the same sequence or a different sequence of modular stator inserts 100 than was removed in process block 1220. Thus, stator assembly 300 may be reconditioned and/or repurposed with different stator properties as a field operation.

In an implementation described herein, a stator segment is provided for a helical gear device. The stator segment includes a stator tube and modular stator inserts. The stator tube has an inner profile with at least two internal sides that extend longitudinally along an interior of the stator tube. The modular stator inserts each have an outer profile that substantially matches and fits within the inner profile of the stator tube. The modular stator inserts also each have an interior helical profile that defines a central opening. The modular stator inserts are configured to be removably inserted longitudinally into the stator tube along the inner profile of the stator tube. The inner profile aligns the modular stator inserts to form a continuous helical chamber and prevents rotation of the modular stator inserts relative to the stator tube.

According to another implementation, a method for assembling a stator segment is provided. The method includes providing a stator tube with a non-circular inner profile and selecting modular stator inserts with an exterior profile that matches the inner profile and fits within the inner profile. The method also includes inserting the selected modular stator inserts into the stator tube. The inner profile aligns the modular stator inserts to form a continuous helical chamber and prevents rotation of the modular stator inserts relative to the stator tube. The method further comprises securing a stopper ring at an end of the stator tube to prevent longitudinal movement, in at least one direction, of the modular stator inserts within the stator tube.

The systems and methods described here simplify assembly of stator segments. The use of matching non-circular profiles on the stator tube and modular stator inserts, as describe herein, enable simple alignment without use of an alignment core and eliminates the need for bonding, primers, and curing of elastomers inside the stator tube. Worn modular stator inserts may be removed and replaced in the stator tube as a field operation, which can reduce out-of-service time and reduce the number of on-site stator tube spares needed to maintain continuous operations. Spare modular stator inserts may be provided and stored separately at customer locations for efficient field repairs.

The foregoing description of implementations provides illustration and description, but is not intended to be exhaustive or to limit the invention to the precise form disclosed. Modifications and variations are possible in light of the above teachings or may be acquired from practice of the invention. For example, while a series of blocks have been described with regard to FIGS. 11 and 12, the order of the blocks and message/operation flows may be modified in other embodiments. Further, non-dependent blocks may be performed in parallel.

Although the invention has been described in detail above, it is expressly understood that it will be apparent to persons skilled in the relevant art that the invention may be modified without departing from the spirit of the invention. Various changes of form, design, or arrangement may be made to the invention without departing from the scope of the invention. Different combinations illustrated above may be combined in a single embodiment. Therefore, the above-mentioned description is to be considered exemplary, rather than limiting, and the true scope of the invention is that defined in the following claims.

The terms "a," "an," and "the" are intended to be interpreted to include one or more items. Further, the phrase "based on" is intended to be interpreted as "based, at least in part, on," unless explicitly stated otherwise. The term "and/or" is intended to be interpreted to include any and all combinations of one or more of the associated items. The word "exemplary" is used herein to mean "serving as an example." Any embodiment or implementation described as "exemplary" is not necessarily to be construed as preferred or advantageous over other embodiments or implementations.

Use of ordinal terms such as "first," "second," "third," etc., in the claims to modify a claim element does not by itself connote any priority, precedence, or order of one claim element over another, the temporal order in which acts of a method are performed, the temporal order in which instructions executed by a device are performed, etc., but are used merely as labels to distinguish one claim element having a certain name from another element having a same name (but for use of the ordinal term) to distinguish the claim elements.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. A stator segment for a helical gear device, comprising:

a stator tube including an inner profile with at least two internal sides that extend longitudinally along an interior of the stator tube; and a first modular stator insert including:

an inlet end, an outlet end, an outer profile that substantially matches and fits within the inner profile of the stator tube, the outer profile extending from the inlet end to the outlet end, and an interior helical profile, the interior helical profile defining a central opening through the modular stator insert and extending longitudinally from the inlet end to the outlet end, wherein the first modular stator insert is configured to be removably inserted longitudinally into the stator tube along the inner profile, wherein the inner profile prevents rotation of the first modular stator insert relative to the stator tube, wherein a number of lobes in the interior helical profile is equal to a number of sides of the outer profile, and wherein the interior helical profile is configured to align with an interior helical profile of a second modular stator insert along any of multiple rotational orientations that fit within the inner profile.

2. The stator segment of claim 1, further comprising:

a stopper ring fixedly attached to at least one end of the stator tube, wherein the stopper ring prevents longitudinal movement, in at least one direction, of the first modular stator insert within the stator tube.

3. The stator segment of claim 1, wherein the first modular stator has a different material configuration than the second modular stator.

4. The stator segment of claim 1, wherein the inner profile prevents rotation of the first modular stator insert and the second modular stator insert relative to each other.

5. The stator segment of claim 1, wherein the first modular stator insert includes an elastomer material, and wherein the second modular stator insert does not include an elastomer material.

6. The stator segment of claim 1, wherein the first modular stator insert includes a metal material and a non-metal material.

7. The stator segment of claim 1, wherein the first modular stator insert includes one or more of a bronze material, a ceramic material, or hardened tool steel.

8. The stator segment of claim 1, wherein the first modular stator insert includes a metal material and an elastomeric coating that is cured prior to insertion of the first modular stator insert into the stator tube.

9. The stator segment of claim 1, wherein the interior helical profile is configured to receive a rotor therein.

10. The stator segment of claim 1, wherein the inner profile includes a convex polygon.

11. The stator segment of claim 1, wherein the first modular stator insert has a different axial length than the second modular stator insert.

12. The stator segment of claim 1, wherein the first modular stator insert is secured in the stator tube without bonding material.

13. A method for assembling a stator segment, the method comprising:

providing a stator tube with a non-circular inner profile;

selecting modular stator inserts with an exterior profile that matches the inner profile and fits within the inner profile, wherein each of the modular stator inserts includes an interior helical profile with a number of lobes that is equal to a number of sides of the exterior profile, and wherein the interior helical profile is configured to align with an interior helical profile of a second modular stator insert along any of multiple rotational orientations that fit within the non-circular inner profile; and inserting the selected modular stator inserts into the stator tube, wherein the inner profile prevents rotation of the modular stator inserts relative to the stator tube.

14. The method of claim 13, further comprising:

removing, from the stator tube, one or more previously used modular stator inserts prior to the inserting.

15. The method of claim 14, further comprising:

cleaning, after the removing, the inner profile of the stator tube.

16. The method of claim 13, wherein inserting the selected modular stator inserts into the stator tube comprises:

inserting at least one of the modular stator inserts having a cured elastomeric material.

17. The method of claim 13, wherein inserting the selected modular stator inserts into the stator tube comprises:

inserting a first one of the modular stator inserts having a first material configuration, and inserting a second one of the modular stator inserts having a second material configuration that is different than the first material configuration.

18. The method of claim 13, wherein inserting the selected modular stator inserts into the stator tube comprises:

inserting a first one of the modular stator inserts having a first axial length, and inserting a second one of the modular stator inserts having a second axial length that is different than the first axial length.

19. A stator insert for a stator segment, the stator insert including:

an inlet end, an outlet end, a non-circular outer profile that substantially matches and fits within an inner profile of a stator tube, the outer profile extending from the inlet end to the outlet end, and an interior helical profile, the interior helical profile defining a central opening through the stator insert and extending longitudinally from the inlet end to the outlet end, wherein the stator insert is configured to be removably inserted longitudinally into the stator tube along the inner profile, wherein the matched outer profile and inner profile prevents rotation of the stator insert relative to the stator tube;

wherein a number of lobes in the interior helical profile is equal to a number of sides of the outer profile, and wherein the interior helical profile is configured to align with an interior helical profile of another stator insert along any of multiple rotational orientations that fit within the inner profile of the stator tube.

20. The stator insert of claim 19, wherein the stator insert includes an elastomeric coating that is cured prior to insertion of the stator insert into the stator tube.

* * * * *